United States Patent [19]

White

[11] Patent Number: 4,798,377

[45] Date of Patent: Jan. 17, 1989

[54] BICYCLE HANDLE BAR GRIP WITH EXERCISE

[76] Inventor: James P. White, 8040 S. Yale, Chicago, Ill. 60620

[21] Appl. No.: 120,642

[22] Filed: Nov. 16, 1987

[51] Int. Cl.[4] ..... A63B 5/00; B62K 21/26

[52] U.S. Cl. ..... 272/67; 272/73; 74/551.9

[58] Field of Search ..... 272/67, 68, 73, 140, 272/142, 143, 93; 74/551.2, 551.8, 551.9

[56] References Cited

U.S. PATENT DOCUMENTS 740,443 10/1903 Korth ..... 272/143
1,026,215 5/1912 Korth ..... 272/68
3,713,350 1/1973 Brilando ..... 74/551.9
4,637,605 1/1987 Ritchie ..... 272/73

*Primary Examiner*—Richard J. Apley
*Assistant Examiner*—S. R. Crow

[57] ABSTRACT

A bicycle handle bar grip and handle mounted individually on the ends of a coil spring. The ends of the coil spring extend into the bicycle handle bar grip and handle longitudinally. The bicycle handle bar grip is equipped with a round longitudinal orifice to allow attachment to the end of any bicycle or stationary bicycle handle bar. When the bicycle handle bar grip is attached to a bicycle the user or rider of the bicycle can exercise his or her hands by squeezing the handle toward the bicycle handle bar grip while simultaneously exercise the legs when riding.

3 Claims, 3 Drawing Sheets

BICYCLE HANDLE BAR GRIP WITH EXERCISE

BACKGROUND OF THE INVENTION

This invention relates to bicycle handle bar grips which can be be used as an exercise means for the hand. When riding a bicycle or stationary bicycle the hands are used either to direct the path of motion of the vehicle or to balance the rider. This limits the amount of exercise the hands or arm receives during the riding period. Many athletes who are interested in developing their legs and cardiovascular system are just as concerned about their hands. To develop both hands and legs in todays environment is difficult when utilizing a standard bicycle or stationary bicycle. In order to provide a more uniform workout for the rider, the bicycle handle bar grip with exerciser was invented. It will allow the user to exercise his or her hands while exercising the legs.

Many bicycle handle bar grips have been designed to provide the rider a means to grip the handle bar and direct the path of motion of the vehicle. But, this limits the rider's ability to realize any exercise benefit to the hands.

This limitation becomes more apparent when they are applied to stationary bicycles where the hands are no longer needed to direct the path of the vehicle. By changing the design of the handle bar grip to encompass a exercise means the rider can now perform exercises tailored to the hands while simultaneously riding the bicycle.

Many hand exercise devices have been developed which will increase strength in the hand or arm such as U.S. Pat. No. 4,433,364 dated Feb. 24, 1984. These devices have proven effective at their ability to exercise the hand but limit their user ability to exercise other parts of the anatomy.

To avoid these limitations this invention provides a bicycle handle bar grip equipped with coil spring and handle which will provide the user access to various hand exercises when affixed to any standard bicycle handle bar.

SUMMARY OF THE INVENTION

Accordingly the following objectives and advantages of this invention are claimed: to provide a tool for exercising the hand which can be affixed to a bicycle handle bar and function as a bicycle handle bar grip for the rider, and to provide a tool which would allow simultaneous exercising of the legs and hand when affixed to a standard bicycle. Also, to provide a tool which would require minimum skill and training.

DESCRIPTION OF THE PREFERRED EMBODIMENT

Figure 1:
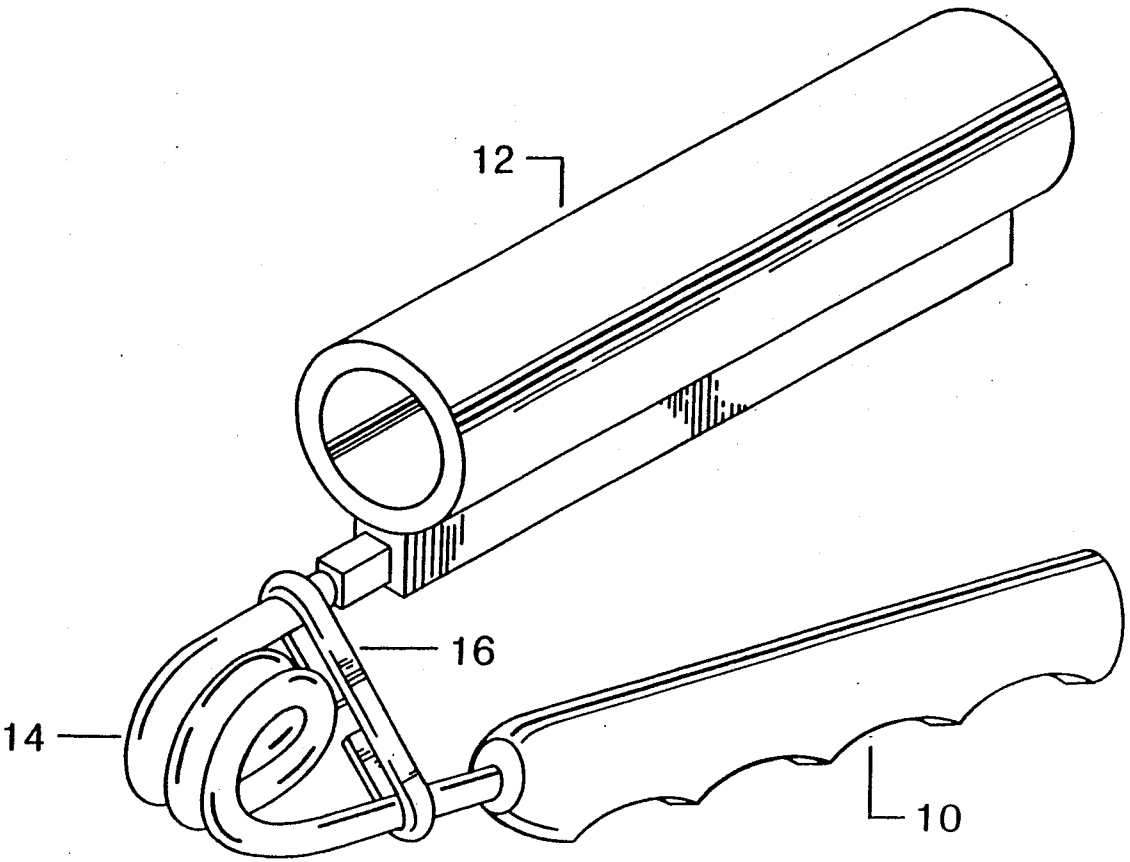
FIG. 1. is a perspective view of the assembled invention.
Figure 2:
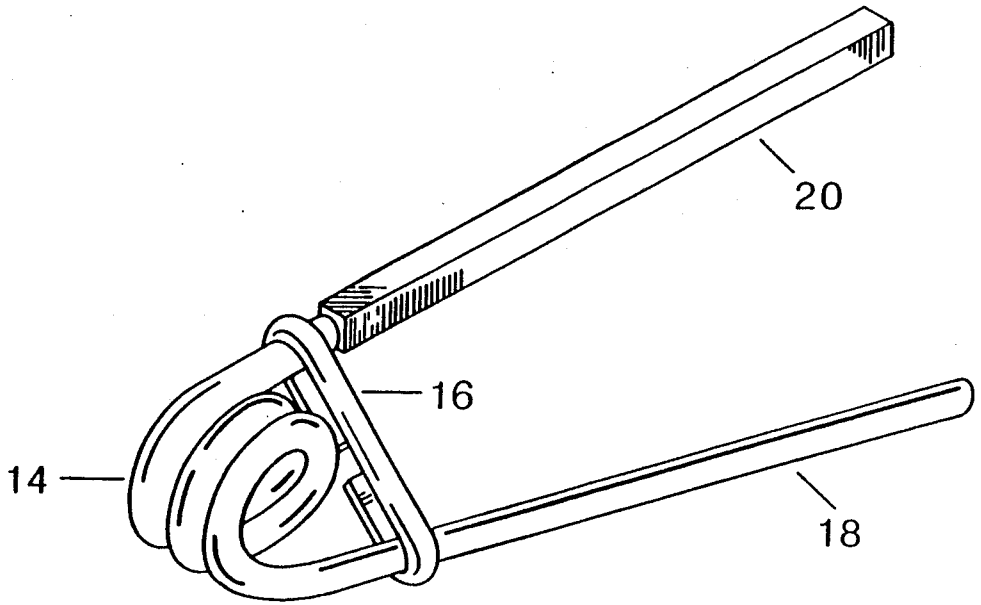
FIG. 2. is a perspective view of the coil spring parts.
Figure 3:
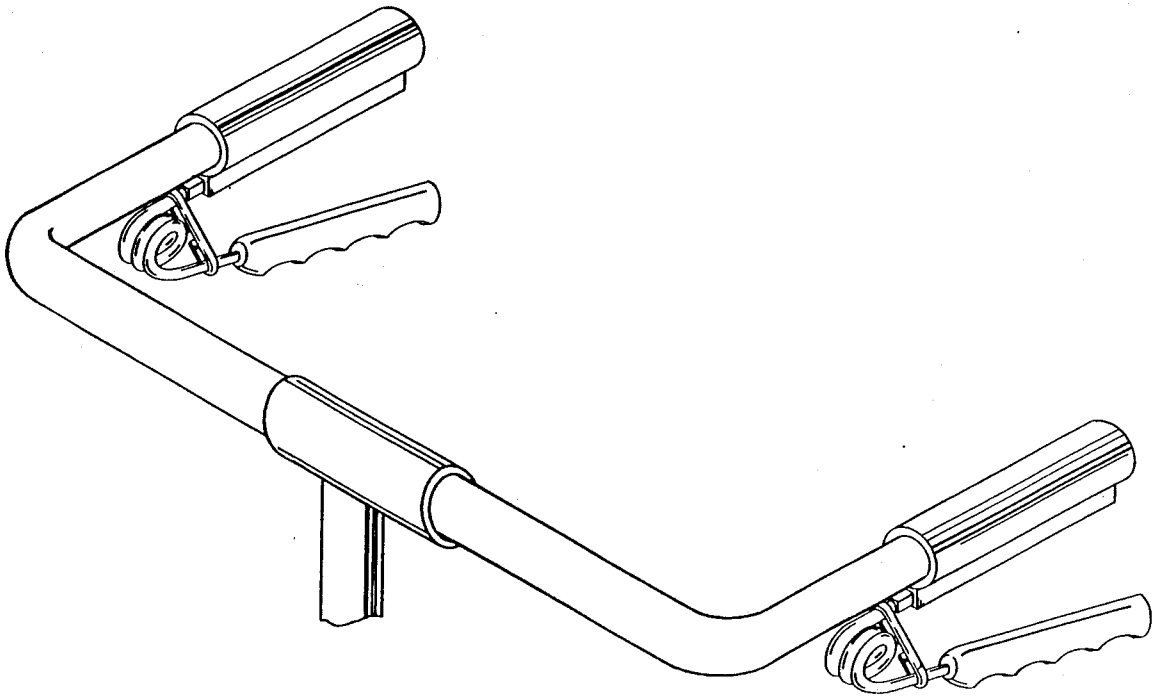
FIG. 3. is a perspective view of the invention in conjunction with a bicycle handle bar.

The invention is illustrated in the accompanying drawing, in which the handle 10 in FIG. 1 is mounted on the handle wire 18 in FIG. 2. The bicycle handle bar grip 12 is mounted on the stabilizing bar 20 in FIG. 2. The coil spring band 16 is wrapped around the coil spring 14 to limit spring expansion. In normal operation the bicycle handle bar grip 12 is mounted on the end of a bicycle handle bar as demonstrated in FIG. 3. The user would mount the bicycle in normal riding position and place his or her hand on the bicycle handle bar grip 12 and extend the fingers around the handle 10. By closing and opening the hand the user would experience resistance to closing from the spring constant K of the coil spring 14.

To prevent the handle 10 from rotating about the bicycle handle bar axis, while being squeezed tightly in normal operation, a stabilizing bar 20 in FIG. 2 is affixed in the bicycle handle bar grip 12.

The stabilizing bar 20 in FIG. 2 is designed to prevent the handle 10 from rotating about the bicycle handle bar axis when squeezed. This allows the handle 10 to move in an up and down motion perpendicular to the bicycle handle bar grip.

It will be understood that vairous alterations and modifications may be incorporated into the foregoing without departing from the scope of the inventions as defined by the appended claims.

For example a skilled artisan will readily be able to change the dimensions and shape of various embodiments and also be able to make the bicycle handle bar grip of alternative materials such as wood or rubber.

I claim as my invention:

1. A bicycle handle bar exercise grip comprising:

(a) a coil spring with both ends extended longitudinally about a pivot axis, said coil spring ends having a given cross sectional area throughout their length, (b) an elongated handle with finger receiving portions along the bottom surface, and with an orifice above said portions extending longitudinally into said handle to allow insertion by one of said coil spring ends, (c) an elongated handle bar grip with an upper orifice extending longitudinally into said handle bar grip for insertion by bicycle handle bar, and a smaller rigid orifice, below said upper orifice, extending longitudinally into said handle bar grip parallel to the upper orifice, said smaller orifice having a stabilizing means to prevent the other said coil spring end from rotating when inserted into the smaller orifice, (d) said elongated handle and said elongated handle bar gri providing a variable gripping means for the hand of a bicycle rider, (e) said coil spring having a spring constant K large enough to stabilize said elongated handle and said elongated handle bar grip in the open position when gripped by a partially open hand, whereby the bicycle handle bar exercise grip can be mounted on a bicycle hand bar and provides a variable grip and hand muscle exercise.

2. A bicycle handle bar exercise grip comprising:

(a) a coil spring with both ends extended longitudinally, (b) an elongated handle with finger receiving portions along the bottom surface, and an orifice above said portions extending longitudinally into said handle to allow insertion by one of said coil spring ends, (c) an elongated handle bar grip with an upper orifice extending longitudinally into said handle bar grip, said upper orifice being large enough to accept insertion by a bicycle handle bar, said handle bar grip also equipped with a smaller orifice below said upper orifice with said smaller orifice extending longitudinally into the handle bar grip parallel to the upper orifice, said smaller orifice having a stabilizing means to prevent said coil spring end from rotating when inserted into the smaller orifice, (d) a coil spring band to confine expansion of said spring ends, whereby the bicycle handle bar variable grip can be mounted on a bicycle and gripped by the rider's whole hand in a partially open position and thereby provides the rider gripping and hand exercise.

3. The bicycle handle bar grip of claim 1 wherein said coil spring equipped with a handle wire which can be inserted into said elongated handle, and a stabilizing bar 20, having a given cross sectional area throughout its length, can be inserted into said smaller rigid orifice of said elongated bicycle handle bar grip to prevent said stabilizing bar from rotating within said elongated bicycle handle bar grip, whereby a human can grip said handle and said bicycle handle bar grip with the hand a squeeze the handle toward the handle bar grip without accidental rotation of said stabilizing bar 20 about the longitudinally axis.

* * * * *